US005710423A

United States Patent [19]

Biven et al.

[11] Patent Number: 5,710,423

[45] Date of Patent: Jan. 20, 1998

[54] EXO-ATMOSPHERIC MISSILE INTERCEPT SYSTEM EMPLOYING TANDEM INTERCEPTORS TO OVERCOME UNFAVORABLE SUN POSITIONS

[75] Inventors: Earl U. Biven, Irvine; James A. Kiefer, San Clemente, both of Calif.

[73] Assignee: McDonnell Douglas Corporation, Huntington Beach, Calif.

[21] Appl. No.: 721,478

[22] Filed: Sep. 27, 1996

[51] Int. Cl.[6] ..... F41G 7/00; F42B 15/00

[52] U.S. Cl. ..... 244/3.1; 244/3.11; 244/3.15

[58] Field of Search ..... 244/3.1, 3.11, 244/3.15, 3.16; 89/1.11

[56] References Cited

U.S. PATENT DOCUMENTS

| | | | |
|---|---|---|---|
| 4,244,540 | 1/1981 | Vollmerhausen | 244/3.16 |
| 4,553,718 | 11/1985 | Pinson | 244/3.15 |
| 4,738,411 | 4/1988 | Ahlström et al. | 244/3.15 |
| 4,796,834 | 1/1989 | Ahlstrom | 244/3.16 |
| 4,836,672 | 6/1989 | Naiman et al. | 89/1.11 |
| 4,848,208 | 7/1989 | Kosman | 244/3.15 |
| 4,988,058 | 1/1991 | Dirscherl et al. | 244/3.16 |
| 5,050,818 | 9/1991 | Sundermeyer | 244/3.15 |
| 5,067,411 | 11/1991 | Ball | 244/3.11 |
| 5,153,366 | 10/1992 | Lucas | 89/1.11 |
| 5,428,221 | 6/1995 | Bushman | 244/3.16 |
| 5,458,041 | 10/1995 | Sun et al. | 89/1.11 |
| 5,464,174 | 11/1995 | Laures | 244/3.15 |

*Primary Examiner*—Michael J. Carone
*Assistant Examiner*—Theresa M. Wesson
*Attorney, Agent, or Firm*—The Bell Seltzer Intellectual Property Law Group of Alston & Bird LLP

[57] ABSTRACT

A missile intercept system using radiation sensors for guidance that can avoid intercept uncertainty due to unfavorable positions of intense radiation sources, like the sun, moon, or countermeasures flares. When the sensor viewing angle is close to such intense radiation sources, the optics on the kill vehicle may be substantially degraded or even destroyed. The potential for an "out of the sun" attack cannot be avoided when international treaties restrict each country to a single defense site while potential launch sites are proliferating about the globe. Therefore, two kill vehicles are launched when an intercept planner determines that the viewing angle from the kill vehicle to the target vehicle will be looking at or near the sun during the engagement. A surrogate kill vehicle is launched on a trajectory that will "fly-by" the target vehicle with viewing angles that will not "see" the sun. The surrogate kill vehicle then sends tracking data to the other kill vehicle for use by the second kill vehicle to guide itself to the intercept. This system allows the use of missiles in development on existing Exo-atmospheric Kill Vehicle (EKV) programs with minimal cost impact to those programs.

20 Claims, 4 Drawing Sheets

Fig. 3B

EXO-ATMOSPHERIC MISSILE INTERCEPT SYSTEM EMPLOYING TANDEM INTERCEPTORS TO OVERCOME UNFAVORABLE SUN POSITIONS

FIELD OF THE INVENTION

This invention relates to the field of missile midcourse interception systems and how to adapt currently developed missile systems to overcome "out of the sun" attacks.

BACKGROUND OF THE INVENTION

The Ground Based Interceptor (GBI) is the weapon system element for the National Missile Defense (NMD) of the United States. The purpose of GBI is to intercept enemy missiles in the midcourse of their flight to aim points in the United States. The region along the target trajectory where intercepts are kinematically able to be conducted by the GBI and meet all Battle Management constraints (e.g. keep-out regions, forward-based sensor coverage, space-based sensor coverage, etc.) is referred to as the battlespace. The intercept (s) could take place anywhere in the battlespace. The GBI weapon system is composed of a booster, a kill vehicle (KV) and the ground equipment required to launch the missile. The part of the GBI remaining after the boost phase, the kill vehicle, is the part that intercepts the enemy warhead. Current versions of the kill vehicle (being developed on the Exo-Atmospheric Kill Vehicle (EKV) Program) have only optical sensors to support the endgame functions including: acquisition of the threat complex, resolution of the objects, tracking the credible objects, discrimination of the threat objects and homing in on the threat warhead, also called the reentry vehicle. The performance of the optical sensors degrade rapidly as the line-of-sight from the kill vehicle to the threat complex "looks" near the direction of the sun.

The GBI element currently is restricted to a single defense site in compliance with the 1972 Anti-Ballistic Missile (ABM) Treaty. From a single site, there are certain hours of the day, during certain days of the year when the GBI kill vehicle optical sensors, in viewing the threat complex, will have to look towards the sun along parts of the battlespace. Battle Management can include sun viewing constraints in the battlespace determination and planning the intercept, but this typically reduces the total battlespace so much that multiple intercept opportunities will be significantly reduced due primarily to the limited kinematic capability of the GBI. Salvo launches can be used to maintain system performance, but at the expense of interceptor inventory.

Against an accidental or random threat, the probability of a sun problem is low, on the order of a few percent. However, against a threat from a terrorist country or an unauthorized threat launch from the former U.S.S.R., where the offense controls the time of day and day of year for the attack, the probability of an intercept geometry with a severe sun viewing problem increases significantly and creates a real concern for the defense of the United States. The problem can be solved by redesign of the current systems (e.g. major kill vehicle redesign, increased inventory or basing changes (that may violate treaty compliance)). This will require a significant and politically unpopular increase in cost as well as a significant delay in fielding an operational system.

Alternative solutions to the sun problem include the addition of a long range radar to the kill vehicle sensor suite to allow radar tracking of the threat complex in or near the direction of the sun. In this case, the optical sensors would no longer be able to supply the discrimination observables.

This means that the discrimination schema would need a new set of discrimination algorithms that accommodates the radar discrimination observable measurements, which in some cases, (particularly for the more advanced threats), will be inadequate for discriminating the reentry vehicle. Moreover, adding such a radar (i.e. with acquisition range on the order of a few hundred kilometers against a small radar cross section reentry vehicle) to the sensor suite would impose a large kill vehicle weight penalty and require a new design for the kill vehicle, including new software. Two other alternatives are to have a kill vehicle sensor that can separate from the propulsive part of the kill vehicle, or to include, on a single booster, a kill vehicle and separate sensor package. These latter two concepts require significant modifications to the kill vehicles currently being developed on the EKV Program, the EKV Program system concept of operation and the total EKV Program.

In the past, others have considered using multiple interceptor vehicles to kill a target. Typically, their applications and approaches are significantly different than those used/described in this invention due primarily to the intercept environments and interceptor capabilities. For instance, Pinson in U.S. Pat. No. 4,553,718 discloses a system for engaging a large naval ship (hundreds of square meters in cross-section) moving at 10's of meters per second. The engagement is carried out entirely in the atmosphere, near the interceptor launch point and uses closed-loop homing guidance to get close to the target naval vessel and explode. Pinson's invention coordinates different missiles for multiple interceptions of the target. By comparison, this invention addresses a totally different problem both in engagement environment and kill mechanism than Pinson's patent. As such, this invention uses existing kill vehicles and a system (both of which will require some minor software and communications modifications) that intercepts targets that are (a) a fraction of a meter in cross-section, (b) moving at 1000's of meters per second, (c) outside the atmosphere and (d) thousands of kilometers from the interceptor launch point. Also, the intercept is performed by actually colliding with the target reentry vehicle rather than killing it with explosive devices. In addition, only one kill vehicle is used to destroy the target—not several kill vehicles as in Pinson's patent. All of these differences combined preclude this invention from being a mere extension of Pinson's patent.

U.S. Pat. No. 4,738,411 by Ahlstrom et al. discloses a defense system that requires two different interceptor vehicles, one with a transmitter (active sensor) and one with a receiver. One vehicle illuminates the target while the other passively receives the reflected signal and homes in on the target using direct line-of-sight measurements. Such a concept is generally referred to as a bi-static concept. The invention here, by comparison, uses two identical kill vehicles rather than a specialized illuminator/receiver pair. Each kill vehicle is capable of conducting an intercept by itself if the battlespace and sun viewing angles are appropriate as well as acting in concert with another identical kill vehicle in a tandem arrangement to mitigate the sun viewing constraint as in this invention. The kill vehicle operating mode (e.g. autonomous operation or as part of a tandem pair) is determined by the Battle Manager at the time of weapon/target assignment.

U.S. Pat. No. 4,848,208 by Kosman discloses a defense system that solves an entirely different problem. In the 1980's, the threat from the Soviet Union consisted of thousands of lethal targets attacking in swarms of objects. The Kosman invention allows self assignment by interceptors to maximize the number of targets killed in a limited swarm (i.e., subset) of attacking objects. During the Strategic Defense Initiative (SDI) heyday, there were few constraints on conceptual interceptor size and weight, and the equipment each interceptor could carry (e.g. an onboard radar system). In the 1990's, when the massive Soviet threat has gone away to be replaced by third world limited threats, interceptors launched from a single site at Grand Forks, N. Dak. must fly thousands of kilometers to intercept, at most, a few lethal objects. To fly long ranges in time to engage a threat, the interceptor booster burnout velocity must be high, which dictates minimizing the payload weight that it can carry. Current versions of the kill vehicles do not allow the luxury, weight wise, of carrying large sensors (e.g. a heavy radar), etc.

U.S. Pat. No. 5,464,174 by Laures discloses a defense system involving fragmenting or aimed pellet warheads and the problems associated with low relative velocities and shallow approach angles. The invention presented here does not allow for fragmenting warheads since it uses kill vehicles currently under development on the EKV Program that are not explosive, aimable or fragmenting in nature. As such, concepts used in the patent by Laures are not applicable to this invention even as a simple extension.

U.S. Pat. No. 5,067,411 by Ball discloses a defense system that uses two warheads launched by a single booster to kill a single target. The second warhead merely increases the probability of kill. The use of multiple warheads on a single booster is prohibited by the 1972 ABM Treaty. In addition, techniques and approaches used in Ball's patent are not applicable to the use of kill vehicles in tandem and operating on two separate boosters.

U.S. Pat. No. 5,050,818 by Sundermeyer discloses a defense system with remotely controlled beam rider vehicles to intercept the target using four dimensional (space-time) navigation, iterative guidance computations, fragmentation warheads, and proximity fuses to solve a typical intercept. The Sundermeyer patent, or a derivative, is not applicable to the problem being addressed in this invention for the following reasons: (a) Beam rider guidance is not implemented in the kill vehicles under development on the EKV Program and, since this invention uses the EKV kill vehicles, is not appropriate for use in this invention. (b) Beam rider guidance is only effective against slow moving, large targets. Against small and/or fast targets, a miss will ensue so that a proximity fuse and a fragmenting warhead will typically be required to effect a target kill. The environments for the GBI element preclude the use of beam rider guidance due to the extremely high velocities and miss distance requirements in the range of inches. The GBI kill vehicle is required to make a direct hit without the help of a fuse and/or a fragmenting warhead. (c) Using beam rider interceptors in a tandem application where one tracks the target and the other uses the track data to intercept the target is not possible.

U.S. Pat. No. 5,458,041 by Hackman et al. relates to surveillance and suppression of an enemy's air defense sites or other types of ground targets. The missiles are winged vehicles that operate entirely within the lower atmosphere, transmit seeker data on potential target back to a human controller (e.g., pilot) who then selects and directs a missile to attack a chosen target on the ground, rather than an interceptor that is employed entirely outside the atmosphere, uses only passive sensors, operates autonomously during the last few hundred seconds, requires extremely fine accuracy in range and angle measurements, does not "look" at the target (until perhaps the last 1 or 2 seconds before intercept, if necessary) because of the sun in the background, intercepts a target reentry vehicle moving 4000–7000 meters per second with a closing velocity approaching 12,000 meters per second (about 26,000 miles per hour) and must intercept (hit) within a fraction of a meter of a specific aimpoint.

Therefore, there is need to upgrade the systems and/or operational concepts currently being developed for the GBI system in the EKV Program to overcome the "sun problem" without substantially increasing cost or complexity of the EKV systems and without requiring two or more substantially physically separated launch sites.

SUMMARY OF THE INVENTION

The present invention is a system and method to intercept an enemy warhead using tandem kill vehicles during times a single kill vehicle would be rendered useless when "looking into the sun" in the endgame. Each of the two kill vehicles, which are identical, carry out separate responsibilities to effect the kill of the enemy warhead. One vehicle is launched on a "fly-by" trajectory and acquires the threat complex of objects, resolves individual objects, tracks the credible objects, and discriminates the reentry vehicle. The other vehicle is launched on an intercept trajectory and, using the track data from the first kill vehicle, performs the required homing guidance calculations and maneuvers to the reentry vehicle. A Global Positioning Satellite (GPS) positioning system including a GPS receiver on each kill vehicle provides very accurate distance between the kill vehicles because the major error component of the GPS position error is nearly vertical, that is, nearly perpendicular to the line between the kill vehicles, said line being nearly horizontal. Late star shots are used to align the two inertial reference units so they can be treated as a single reference for direction (e.g., angle) estimates. The present invention uses a unique guidance scheme and uses data from two separate sensors to home in on the threat warhead that uses a surrogate kill vehicle to carry out the acquire, resolve, track, and discriminate functions for the actual kill vehicle.

The present invention addresses the developing GBI system in a way to enhance its performance by reducing the sensitivities to solar backgrounds during an engagement. There are modifications required to the developing kill vehicle to implement the present innovation, but these are purposely designed to have minimal impact on the current EKV design. The modifications are primarily software and involve the guidance system (e.g. coordinate transformations, orientation maneuvers, etc.) and communications system changes.

The primary thrust of the present invention is to solve a real problem (i.e., optical sensors looking into the sun) with minor modifications to a current system (the kill vehicle being developed under the EKV Program) while imparting only a small weight penalty and small cost per vehicle. GBI has a sun viewing problem because of the single launch location. In the National Missile Defense-GBI context, the single launch site is a requirement imposed by the 1972 ABM Treaty with the Soviet Union (agreement now transferred to Russia) however the present invention could be used for the air-to-air of interception to reduce the effectiveness of flares dropped by the target vehicle.

Partly to minimize weight and partly to provide appropriate phenomenology for discrimination of the target amongst a complex of fragments and decoys, GBI kill vehicles use optical sensors that provide angle-only measurements. In the present invention, range to the target from the tracking kill vehicle is obtained by digital filtering the line-of-sight measurements relative to its inertial coordinates as the line-of-sight rotates in inertial space.

Angular accuracy is obtained by near simultaneous star sightings of the same two stars by both GBI kill vehicles just prior to the endgame phase of the engagement, so that the errors in relating the inertial measurement unit (IMU) axes of one GBI kill vehicle to the IMU axes of the other GBI kill vehicle are extremely small.

The threat complex potentially contains many objects such as fragments and decoys that optical phenomenology will help separate from the target vehicle (called the reentry vehicle). Although not part of this invention, it takes advantage of the "tracking" GBI kill vehicle's already designed in capability to map out the complex objects and identify the reentry vehicle. The tracking kill vehicle sends the location (range and line-of-sight direction) of the reentry vehicle and other major objects to the "killing" GBI kill vehicle, which then computes and executes the necessary divert maneuvers required to eliminate any errors at intercept time.

The divert calculations also need the accurate distance between the kill vehicles. This is obtained by simultaneous receipt of GPS signals. Guidance accuracy is also improved because the solution triangle is not measured in absolute terms, but relative terms with respect to the three major vehicles, the two GBI kill vehicles and the reentry vehicle. Since the tandem GBI kill vehicles intercept the target up to 7000 kilometers from the GBI launch site, e.g., over Hawaii from launch site at Grand Forks, N. Dak., no ground tracking system aids in the final engagement and the tandem GBI kill vehicles must operate autonomously, as a team, during the last few hundred seconds.

The advantages of the present invention include: a small weight penalty for the current EKV kill vehicles; the discriminants and discrimination scheme (i.e., the same phenomenology) normally used when no sun problem exists are used as designed into the current EKV kill vehicles; capability becomes 24 hours a day, 365 days a year GBI launch operation with full kinematic battlespace utilization from a single site; and the battle manager is allowed additional flexibility in allocating GBI resources.

In summary, the main advantage of the present invention is that it removes a significant battle management constraint (i.e., managing intercepts for sun avoidance) and yet has virtually no technical impact on the current EKV program and thus has minimal cost impact. The only real impact of the present invention on the GBI system concept is a small modification to the operational concept and the kill vehicle guidance algorithms. There needs to be no technology or design impact on the current EKV program.

It therefore is an object of the present invention to provide a method for overcoming the occasions when an intercept of a target reentry vehicle, utilizing a kill vehicle with optical sensors, requires the optical sensors to look near the sun (e.g., the sun impinges into the seeker field-of-view).

Another object of this invention is to overcome the "sun problem" at minimal cost. Another object is to prevent the sun from disabling or significantly reducing the effectiveness of a defense system that is restricted to a single site.

These and other objects and advantages of the present invention will become apparent to those skilled in the art after considering the following detailed specification, together with the accompanying drawings within:

DETAILED DESCRIPTION OF THE PRESENT INVENTION

Figure 1A:
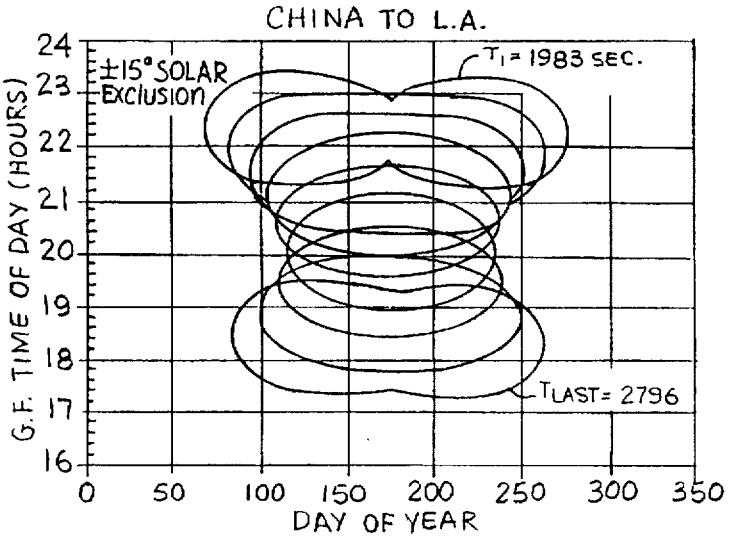
FIGS. 1A, 1B, 1C, 1D, 1E, 1F and 1G show plots of regions of ±15° solar exclusions about the direction to the sun during 1993 where the Vernal Equinox=day 79.6, Summer Solstice=day 172.4, Autumn Equinox=day 266.0 and Winter Solstice=day 355.9 (these day numbers change slightly from year to year)
Figure 1B:
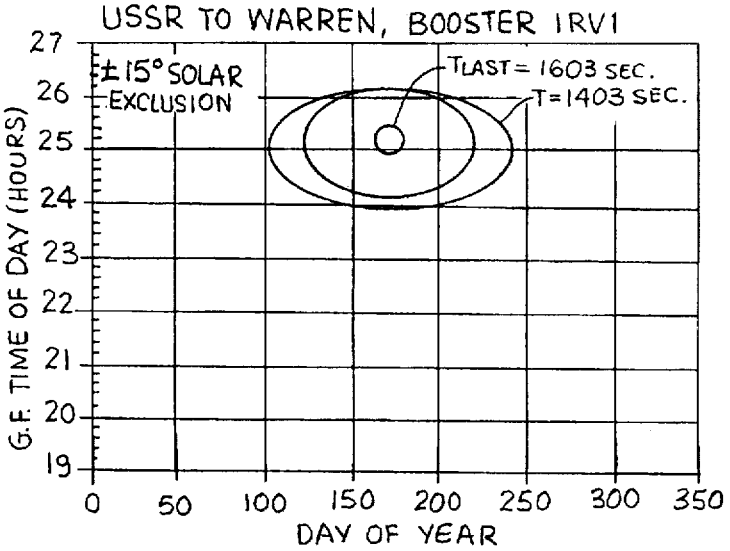
Figure 1C:
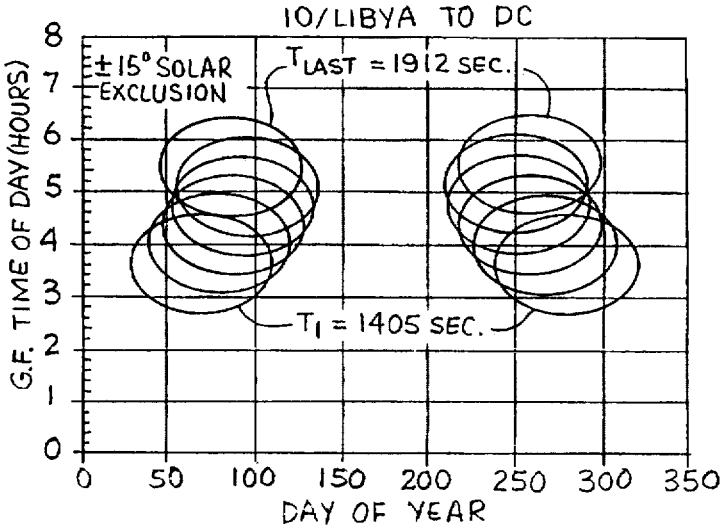
Figure 1D:
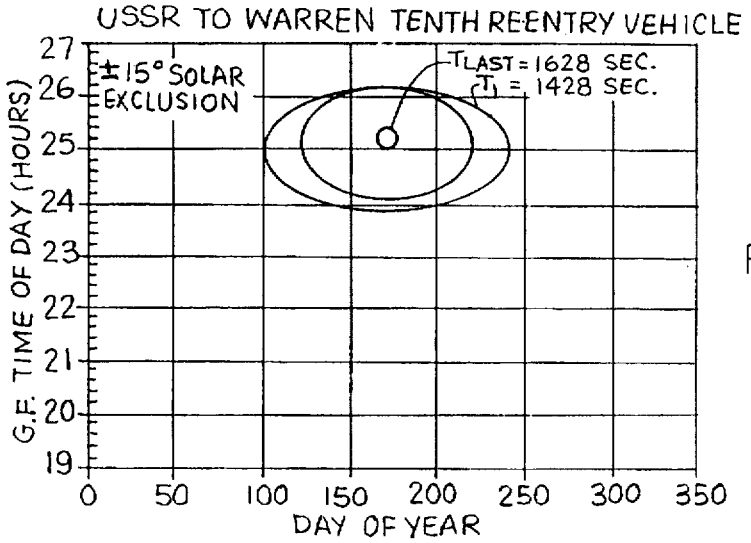
Figure 1E:
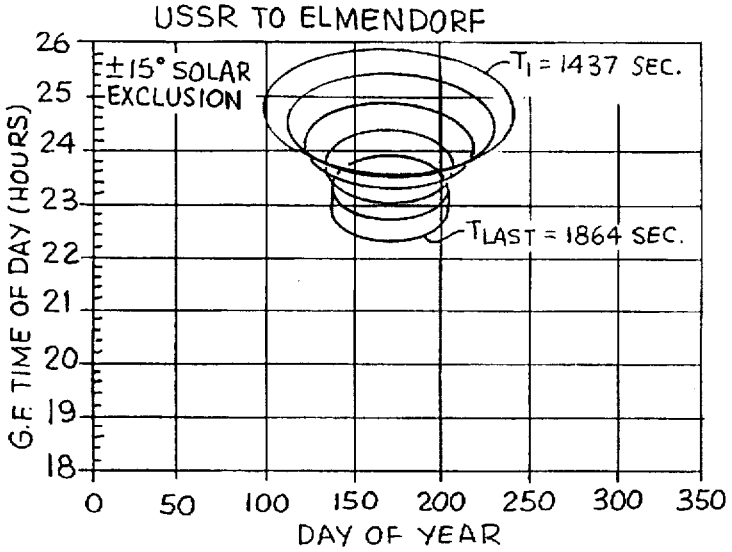
Figure 1F:
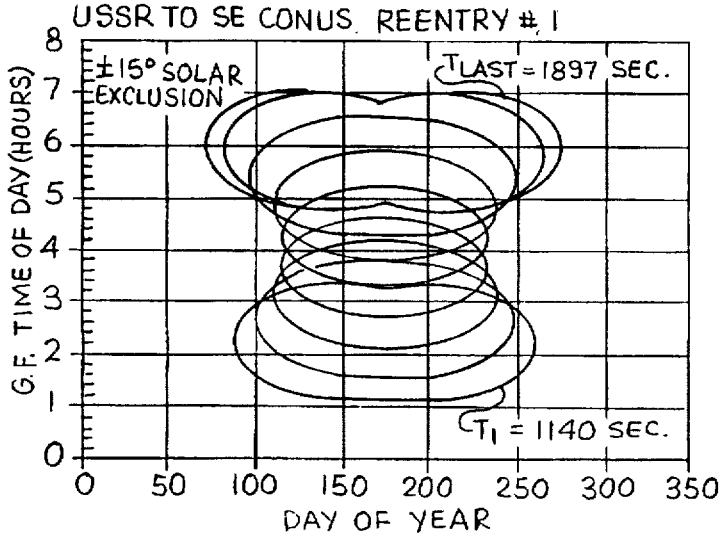
Figure 1G:
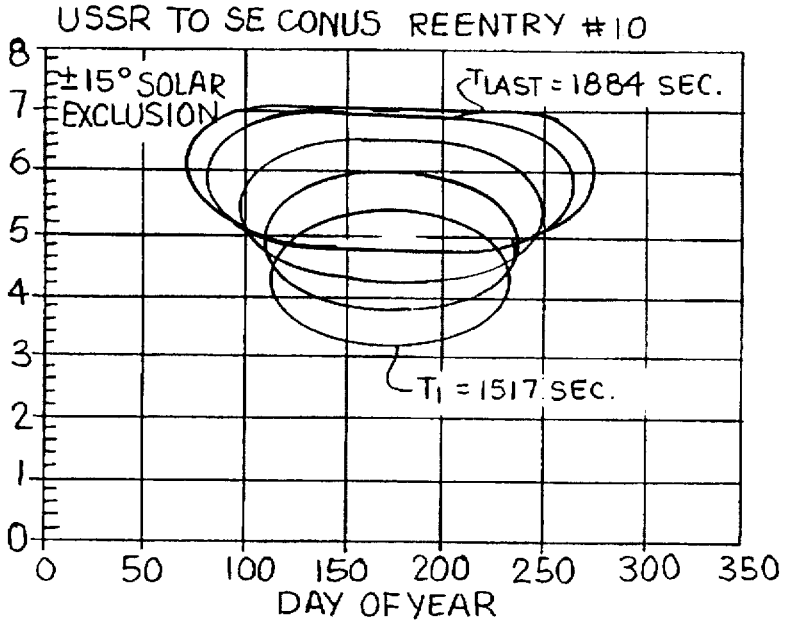

Current EKV sensor suites have optical sensors in the intercept endgame functions to acquire the threat complex, resolve the objects, discriminate, and home in on the target reentry vehicle. These optical sensors degrade rapidly as the line-of-sight to the target from the kill vehicle approaches the direction of the sun.

In order to understand the sun problem and determine what hours of the day and what days of the year would present problems for the optics-only GBI sensor suites, a sun exclusion computer program was developed and exercised against several possible threats to the United States. FIGS. 1A, 1B, 1C, 1D, 1E, 1F and 1G show plots of regions of ±15° solar exclusions about the line-of-sight direction to the sun at about 100 second intervals starting at the time in seconds from launch of a reentry vehicle, $T_1$ and ending at $T_{last}$. The vertical axes represent the times of day (referenced to time at Grand Forks, N. Dak.), near the planned deployment site for the GBI system (which employs the EKV). The horizontal axes are the day of year. The solar exclusion region(s) are denoted by an ellipse-like area, or pairs of "ellipses", or joined pairs of "ellipses". Each ellipse or ellipse pair represents a specific battlespace time or intercept point on the threat trajectory. The exclusion regions, plotted at 100 second increments in the battlespace starting at the first time $T_1$, migrate in the time-of-day, day-of-year space, typically ending at reentry.

From these points, the following is clear. The sun will always pose a potential problem for a single-site GBI system with kill vehicles that have optics-only sensors. Depending on the threat trajectory, solar exclusions may occur during the summer months, during the months about the equinoxes, or during March through September between the equinoxes. If the time scale is expanded to a full 24 hour period, the solar exclusion region is only a small part of the 24 hour times 365 day area. Thus, if the threat is launched at a random time, the probability of GBI encountering a sun problem is low. However, an attack with the sun in mind could increase that probability considerably. It is interesting that for threats to Alaska (Elmendorf A.F.B.) and the central United States, GBI could have a sun problem near midnight, looking over the north pole. Note, the latitude of Libya is so low, the solar exclusion regions for threats to the East coast of the United States (FIG. 1C) are separated into months (or exclusion regions) about each equinox.

For threats to central continental United States, the first intercepts could be delayed by the battle manager due to the sun viewing problem, meaning shoot-evaluate-shoot-evaluate-shoot (3-shot opportunities) scenarios reduce to shoot-evaluate-shoot (2-shot opportunities). The GBI inventory would have to increase due to the increased probability of the need for a GBI salvo (4 to 10 missiles per salvo on the second shot opportunity of the shoot-evaluate-shoot).

Total solar exclusion along the entire battlespace is rare. One example occurs in the former U.S.S.R.-to-Elmendorf scenario shown in FIG. 1E, where the first and the last solar exclusion regions share a common area between days 150 and 200, at about hour 23.5 (11:30 p.m.) Grand Forks time. Despite the rareness of a total solar exclusion along the entire battlespace, overlapping solar exclusion regions for large portions of the battlespace are common.

To avoid these solar exclusion portions of the battlespace, the battle manager must reduce 3-shot opportunities to 2-shot opportunities, and must reduce 2-shot opportunities to a single salvo. To enforce a low reentry leakage, the last shot is always a salvo of several GBIs. The results of battle managing around each sun problem are an increase number of GBIs used and/or an increase in probability that a reentry vehicle will reach its target.

Figure 2:
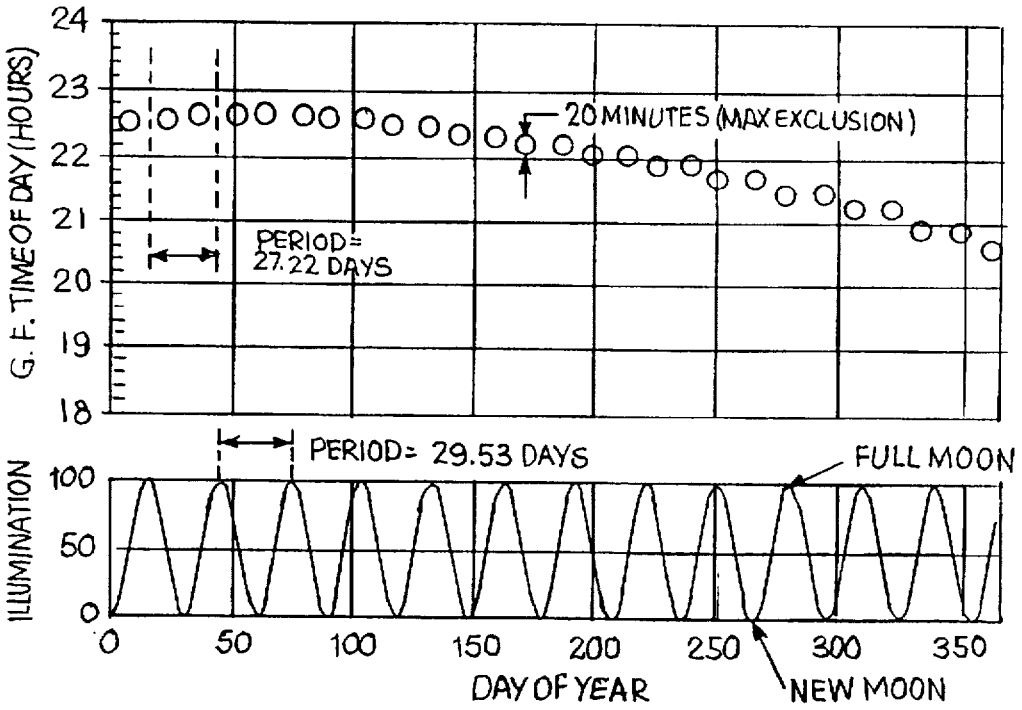
FIG. 2 is a plot of pairs of ellipses (i.e., like the Libya to Washington D.C. plot of FIG. 1C) representing lunar exclusions (defined by a cone of 2.5° half angle to the moon direction) for a single trajectory time and illumination of the moon versus day of the year.

An extension of the solar problem is the "lunar" problem. Although significantly reduced in intensity compared to the sun, an illuminated moon still represents a very bright, warm, and extended source that can overwhelm most target signatures. In addition, the moon goes through 13 cycles a year compared to one cycle for the sun. As shown notionally in FIG. 2, 13 pairs of ellipses (i.e., like the Libya to D.C. plot of FIG. 1C) are shown representing lunar exclusions (defined by a cone of 2.5° half angle to the moon direction) for a single trajectory time where the GBI line-of-sight with respect to the equatorial plane was assumed much less than the maximum 18° to 19° declination (for 1995) of the moon (the moon's maximum declination changes from year to year reaching 28° in some years). The maximum effect on any single day would be a vertical cut through the middle of an exclusion region during a full moon. This represents, at most, a 1.4% reduction in the utility of the optical sensor (e.g., 5° longitude=20 minutes of the day and 20 minutes divided by 24 hours=1.4%) that would occur on, at most, 26 days a year. Most days will have lower reductions and many days have no lunar exclusion at all. Plus, many exclusion days have reduced illumination. For example, day 90 has a full exclusion but no illumination because the phase of the moon is new. Therefore, although the present invention can accommodate a lunar problem, a lunar exclusion is a very minimal problem and also very difficult for the offense to reliably use to advantage.

Figure 3A:
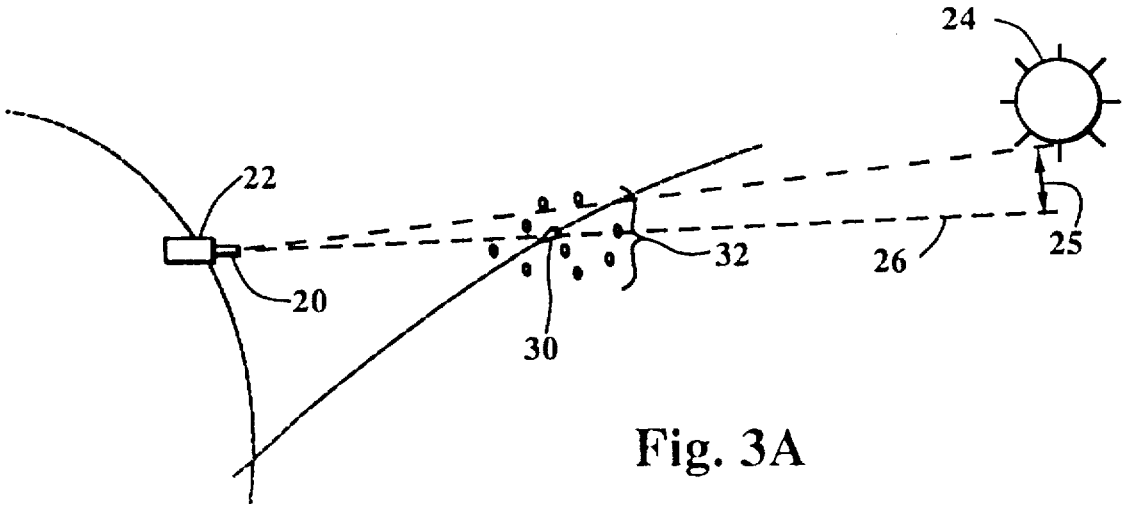
FIG. 3A illustrates the sun problem for a single kill vehicle and 3B illustrates solution for the sun problem of FIG. 3A using tandem kill vehicles.
Figure 3B:
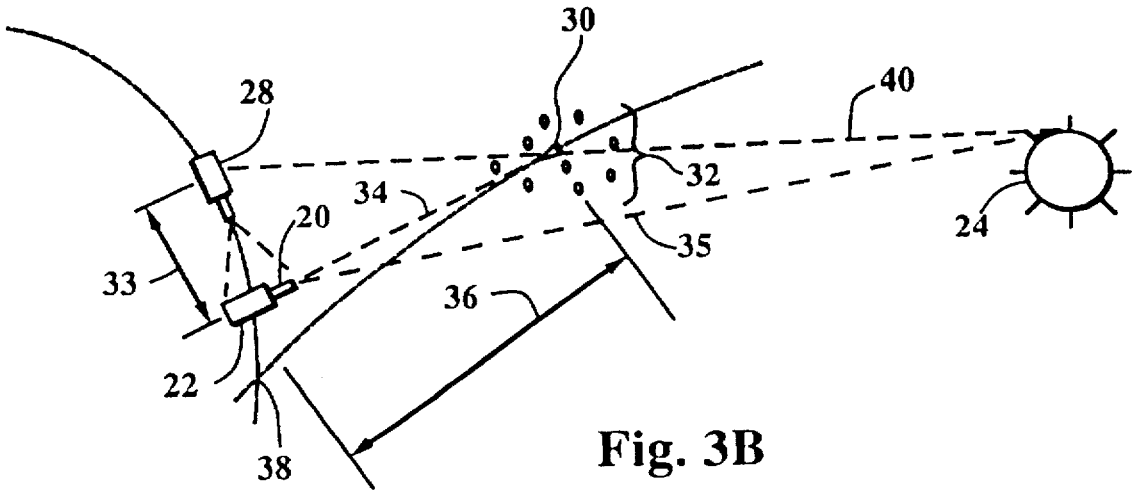

Two GBI kill vehicles flying in tandem can solve the sun viewing problem. FIG. 3A illustrates the sun problem for a single kill vehicle. During the endgame phase, the telescope, 20, of the kill vehicle, 22, points within a few degrees of the direction of the sun, 24. Depending on the size of the offset, 25, of the line-of-sight, 26, from the sun direction, the sensor performance degradation could vary from highly noisy data to total failure due to burnt out detectors. The solution is illustrated in FIG. 3B.

When a sun problem is contemplated, a second GBI, 28, is launched to intercept the reentry vehicle, 30, within the threat complex 32. The second GBI kill vehicle 28 is typically identical to the first GBI kill vehicle 22. GBI 22 is launched earlier (about 1 to 15 seconds) than the second GBI kill vehicle 28 on a flyby trajectory so that GBI kill vehicle 22 leads GBI kill vehicle 28 by a hundred kilometers or so, shown by arrow 33, flying in tandem near intercept. The lead distance, 33, between the kill vehicles 22 and 28 is planned so that the kill vehicle 22 line-of-sight, 34, to the threat complex, 32, will point well away from the direction, 35, of the sun, 24. Kill vehicle 28 looks at and tracks kill vehicle 22 while homing in to hit and kill the reentry vehicle 30. Just prior to the endgame phase, both kill vehicles 22 and 28 perform "star shots" so that their inertial references will be nearly aligned to each other. The GPS position system of each kill vehicle collects military GPS data (much more accurate than civilian GPS data) which is used to compute the distance 33 between the kill vehicles 22 and 28. In order to minimize GPS errors, the trajectories of the kill vehicles 22 and 28 are generally in the same horizontal plane. The distance between the reentry vehicle 30 and kill vehicle 22 initially is estimated by earlier predictions, then updated during the endgame as the angle of the line-of-sight 34 of the kill vehicle 22 to the reentry vehicle changes with respect to the inertial reference. Kill vehicle 22 acquires the threat complex, resolves the credible objects, carries out the discrimination process, and designates the reentry vehicle 30. Kill vehicle 22 then transmits the angle of its line-of-sight 34, and range 36 to the reentry vehicle 30, to the kill vehicle 28 for homing guidance. Kill vehicle 28 computes the guidance required, homes in to the reentry vehicle 30, and physically hits the reentry vehicle 30 at the intercept point 38 to kill it. If the guidance cannot accomplish a hit-to-kill intercept, two late endgame alternatives are possible: if the line-of-sight 40 of the kill vehicle 28 is not pointed directly into the disk of the sun 24, its optical sensors may be turned on and used in the final seconds to effect hit-to-kill; or a small (i.e., lightweight and short range) radar may be included in the GBI sensor suite so that the second kill vehicle 28 can track the reentry vehicle 30 and provide data for the guidance and aimpoint selection algorithms in the final 1–2 seconds before it intercepts the reentry vehicle. The kill vehicle 22 could be launched at the same time as the kill vehicle 28 but with a different trajectory that avoids requiring a line-of-sight to the reentry vehicle 30 toward the sun 24 so long as the different trajectory causes the kill vehicles 22 and 28 to remain in the same horizontal plane, where GPS accuracy is highest.

The present invention is applicable to any missile interceptor that uses an optical sensor to home in on its target, but is more directly applicable when there is only a single origin (i.e., launch point) available for the missile. If the enemy "attacks from the direction of the sun", the optical sensor could be rendered useless. Since each application is different, the extra equipment and software needed depends on the particular interceptor being modified. In the case of the Theater High Altitude Area Defense (THAAD) missile for Theater Missile Defense (TMD), where defense batteries are hundreds of miles apart, the offense could use "attacks from the direction of the sun" on all attacks to at least preclude use of the full battlespace against the threat. Tandem THAADs could negate that offense tactic.

Thus, there has been shown novel EKV systems updates and methods of use, which fulfill all of the objects and advantages sought therefor. Many changes, alterations, modifications and other uses and applications of the subject invention will become apparent to those skilled in the art after considering the specification together with the accompanying drawings. All such changes, alterations and modifications which do not depart from the spirit and scope of the invention are deemed to be covered by the invention which is limited only by the claims that follow:

We claim:

1. A method of guiding interceptors that include only light sensitive sensors for terminal guidance and that are launched from a single geographic area to an object in the presence of predictable light radiators including:

determining when the light sensitive sensor of an interceptor will be pointed toward a light radiator during a terminal phase of an interception;

launching first and second interceptors along respective trajectories at different times, wherein the trajectory of the first interceptor is selected such that the first interceptor will not intercept the object, and wherein the trajectory of the second interceptor is selected such that the second interceptor will intercept the object;

tracking the object with the first interceptor;

providing intercept information to the second interceptor from the first interceptor; and using the intercept information in the second interceptor to guide the second interceptor to intercept the object.

2. The method as defined in claim 1 wherein the interceptors each include GPS positioning systems, the method further including:

determining the range between the interceptors by comparing GPS positions.

3. The method as defined in claim 1 including:

launching the first interceptor prior to the second interceptor.

4. The method as defined in claim 3 including:

determining an angle between the interceptors by:

pointing the light sensitive sensor of the second interceptor at the first interceptor during the terminal phase of the interception.

5. The method as defined in claim 1 including:

pointing the light sensitive sensor of the second interceptor away from the light radiator during the terminal phase of the interception.

6. The method as defined by claim 1 including:

intercepting the object by physically hitting the object with the second interceptor.

7. The method as defined in claim 1 wherein the launching of the first and second interceptors includes:

launching the first and second interceptors about 1 to 15 seconds apart.

8. The method as defined in claim 1 wherein the launching of the first and second interceptors includes:

launching the first and second interceptors with a time interval between launches that results in a spacing of about 100 kilometers between the interceptors during the terminal phase.

9. A method of avoiding sun degradation of a light sensitive sensor in the kill vehicles of an exo-atmospheric single site contract kill vehicle system including:

determining when the light sensitive sensor of a contact kill vehicle will be pointed toward the sun during a terminal phase of an interception of a reentry vehicle;

launching a surrogate kill vehicle and a contact kill vehicle at different times, wherein only the contact kill vehicle is launched during a proper intercept time period, whereby the contact kill vehicle follows a similar trajectory to that of the surrogate kill vehicle;

acquiring a threat complex of the reentry vehicle with the light sensitive sensor of the surrogate kill vehicle;

resolving the reentry vehicle in the threat complex from other components of the threat complex with the light sensitive sensor of the surrogate kill vehicle;

tracking the reentry vehicle with the light sensitive sensor of the surrogate kill vehicle;

providing intercept data to the contact kill vehicle from the surrogate kill vehicle; and using the intercept data in the contact kill vehicle to guide the contact kill vehicle to intercept of the reentry vehicle.

10. The method as defined in claim 9 wherein the kill vehicles each include GPS positioning systems, the method further including:

determining the range between the kill vehicles by comparing GPS positions.

11. The method as defined in claim 9 including:

launching the surrogate kill vehicle prior to the contact kill vehicle.

12. The method as defined in claim 11 including:

determining an angle between the kill vehicles by:

pointing the light sensitive sensor of the contact kill vehicle at the surrogate kill vehicle during the terminal phase of the interception.

13. The method as defined in claim 11 wherein the kill vehicles are identical.

14. The method as defined in claim 13 including:

intercepting the object by physically hitting the object with the contact kill vehicle.

15. The method as defined in claim 13 wherein the launching of the kill vehicles includes:

launching the surrogate kill vehicle about 1 to 15 seconds before launching the contact kill vehicle.

16. A method of avoiding degradation of radiation sensitive sensors of interceptors due to intense sources of radiation including:

determining when the radiation sensitive sensor of an interceptor vehicle will be pointed toward an intense source of radiation during interception of an object;

launching first and second identical interceptors along respective trajectories with an interval there between, wherein the trajectory of the first interceptor is selected such that the first interceptor will not intercept the object and such that a line of sight defined by the radiation sensitive sensor of the first interceptor will not intersect the intense source of radiation while the radiation sensitive sensor points at the object;

tracking the object to be intercepted with the first interceptor;

providing intercept information to the second interceptor from the first interceptor; and using the intercept information in the second interceptor to guide the second interceptor to intercept the object.

17. The method as defined in claim 16 wherein the interceptors each include GPS positioning systems, the method further including:

determining the range between the interceptors by comparing GPS positions, the trajectories of the interceptors being generally in the same horizontal plane to minimize GPS errors.

18. The method as defined in claim 16 including:

determining an angle between the interceptors by:

pointing the radiation sensitive sensor of the second interceptor at the first interceptor.

19. The method as defined in claim 16 including:

pointing the radiation sensitive sensor of the second interceptor away from the intense source of radiation.

20. The method as defined in claim 16 wherein the launching of the interceptors includes:

launching the first and second interceptors about 1 to 15 seconds apart.

* * * * *